United States Patent [19]

Kapstad

[11] 3,955,298

[45] May 11, 1976

[54] POSTER DISPLAY FRAME

[76] Inventor: Odd B. Kapstad, 5 Minot Ave., Acton, Mass. 01720

[22] Filed: Jan. 31, 1975

[21] Appl. No.: 545,950

[52] U.S. Cl. ..... 40/152; 40/125 H; 52/656

[51] Int. Cl.[2] ..... G09F 01/12

[58] Field of Search ..... 40/152, 125 R, 125 H, 40/125 F, 156, 125 D, 152.1; 52/656, 758 H

[56] References Cited

UNITED STATES PATENTS

| | | | |
|---|---|---|---|
| 2,804,952 | 9/1957 | Nothdurft | 40/152 UX |
| 3,302,351 | 2/1967 | Trulaske | 52/656 X |
| 3,428,108 | 2/1969 | Singer | 40/125 R |
| 3,783,543 | 1/1974 | Hemgren | 40/152 |
| 3,811,214 | 5/1974 | Tate | 40/152 |
| 3,877,165 | 4/1975 | Lumbard | 40/152 |

*Primary Examiner*—Louis G. Mancene
*Assistant Examiner*—John F. Pitrelli
*Attorney, Agent, or Firm*—David E. Brook

[57] ABSTRACT

A frame for displaying a poster is disclosed which is formed from a plurality of frame members joined together. The poster can be retained in a mounting groove or slot provided on each frame member. Each frame member also contains first and second guide means defining a slot therebetween into which a joiner, such as an L-shaped angle joiner, can be inserted to join frame members together.

7 Claims, 9 Drawing Figures

POSTER DISPLAY FRAME

BACKGROUND OF THE INVENTION

1. Field of the Invention

This invention is in the field of display frames and more particularly in the field of display frames particularly adapted to display posters and the like.

2. Description of the Prior Art

It is often desirable to display information bearing sheets such as posters or other signage. Much information is transmitted in this manner, particularly in the field of advertising.

It is known, of course, to insert such information-bearing posters into display frames. Nevertheless, there is always a need for new, unique and aesthetically pleasing poster frames which offer outstanding advantages. Such frames would be, for example, inexpensive, easily constructed, flexible, attractive, etc.

SUMMARY OF THE INVENTION

The invention described herein comprises a new and uniquely designed poster display frame. This frame is formed from a plurality of frame members which are joined together to provide a frame suitable for securing and displaying one or more posters. Typically, each frame member contains a groove into which one edge of a poster can be inserted or other such means for mounting posters.

The frame members have a unique internal construction which allows their joinder. Thus, first and second guide means are contained therein which define a slot therebetween for receiving one leg of a frame joiner. One suitable joiner is an L-shaped angle joiner wherein each leg is inserted into a different frame member to join them at a right angle. The joiner also has thereon means for cooperating with the second guide means within the frame members to lock the joiner into place. Suitable means for cooperating comprise one or more raised tongues which press against a shoulder or wall forming the second guide means within frame members.

Because of their unique construction, the frame members described herein can be used to construct frames which have a number of significant features. For example, the frames are extremely flexible, and can be easily assembled and disassembled using a build-on concept which permits expansion of display units as desired. Also, the frame displays can be extended by the addition of standard accessories such as spot lights, literature racks and counter units. A plurality of frames can be joined with swivel hinges to allow the frames to be oriented in any direction with respect to each other thereby allowing unlimited poster frame configurations. The frames can be easily mounted using standard fixtures to suspend the frames from ceilings, walls, display posts, etc. Another desirable feature is that the frames can be fabricated to provide for lighting means behind posters displayed for back-lit presentations. Since the frames can be extruded from aluminum, they are inexpensive and easily manufactured.

DESCRIPTION OF PREFERRED EMBODIMENTS

Figure 1:
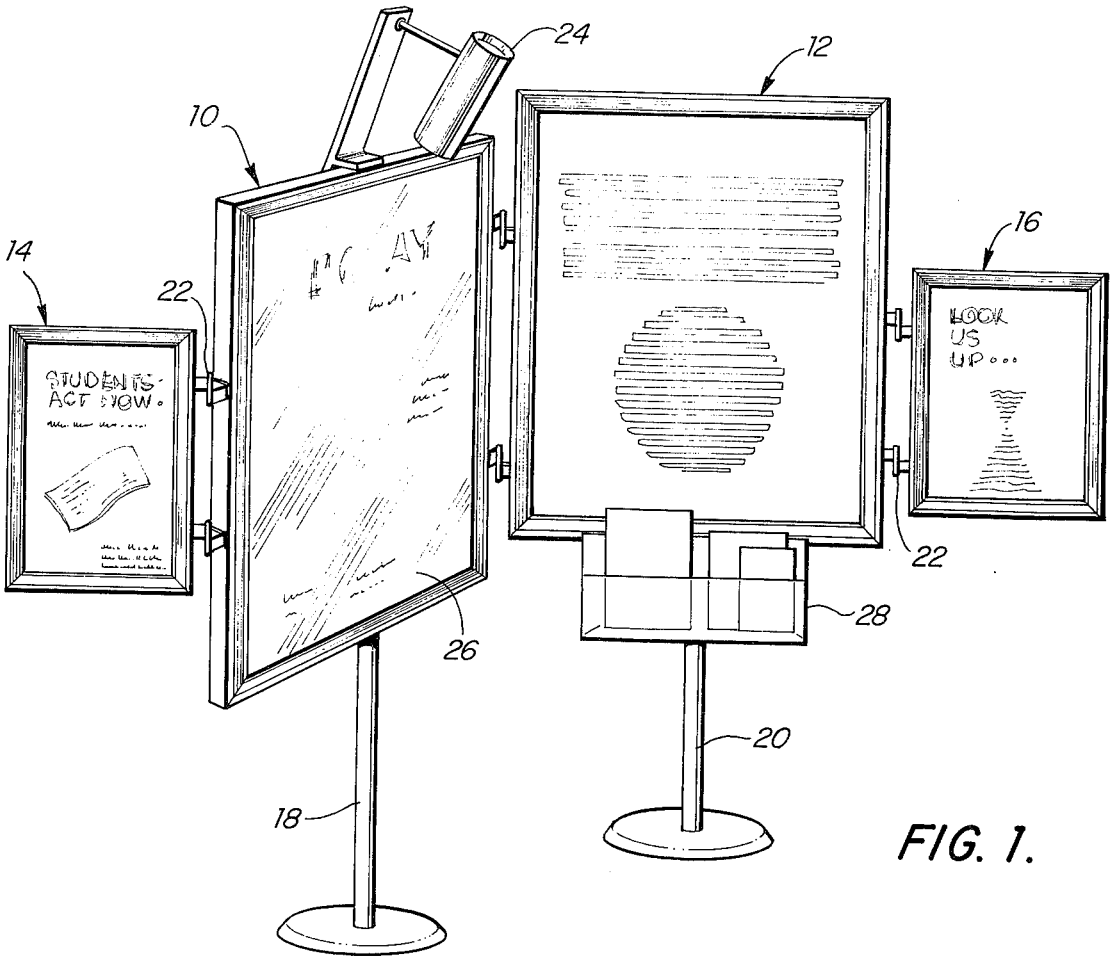
FIG. 1 is a perspective view of a poster display assembly formed from a plurality of frames as described herein.

Referring now to the Figures in more detail, the poster display assembly illustrated in FIG. 1 is formed from two large poster frames 10 and 12 with smaller display frames 14 and 16 fastened respectively to each. Frames 10, 12, 14 and 16 are fabricated from an upper, a lower, and two side frame members which are joined together right angles to form the rectangular frames. This assembly is supported by pedestals 18 and 20 which are clamped to the lower frame members of frames 10 and 12, respectively. Frames 10, 12, 14 and 16 ae joined to each other by swivel hinges 22 which allow these frames to be oriented with respect to each other in a wide variety of positions thereby providing increased flexibility in designing specific configurations.

In addition to the frames and pedestals, the assembly contains several accessories. Thus, a display lamp 24 is mounted at the top of frame 10 to illuminate information displayed on poster 26 contained therein. A display rack 28 is attached to the lower frame member of frame 12 thereby providing the capability of providing flyers, brochures, etc.

Figure 2:
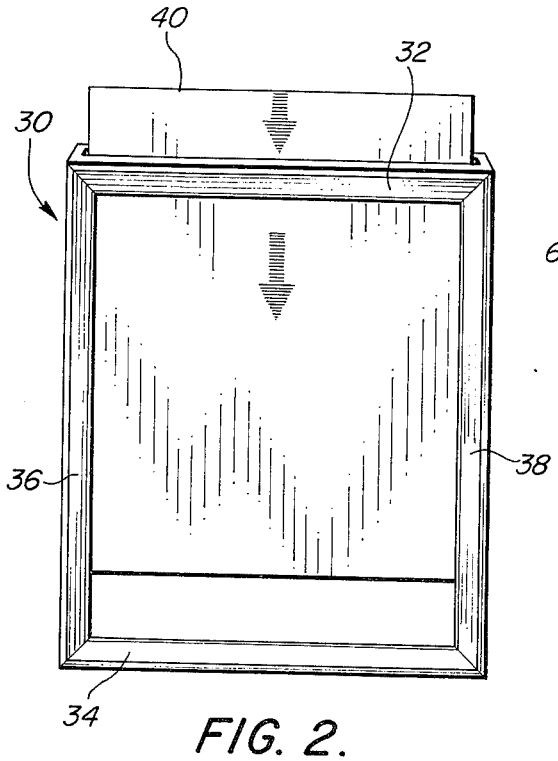
FIG. 2 is an elevation view of a single frame illustrating how a poster is inserted therein.

In FIG. 2, a frame 30 is illustrated which consists of upper frame member 32, lower frame member 34, and side frame members 36 and 38. Each is joined at a right angle at its extremity and the ends are cut to dovetail those of other frame members. Upper frame member 32 has two separate channels forming a slot therebetween whereas the other frame members contain a poster groove so that poster 40 can be inserted into frame 30 and securely held therein.

Figure 3:
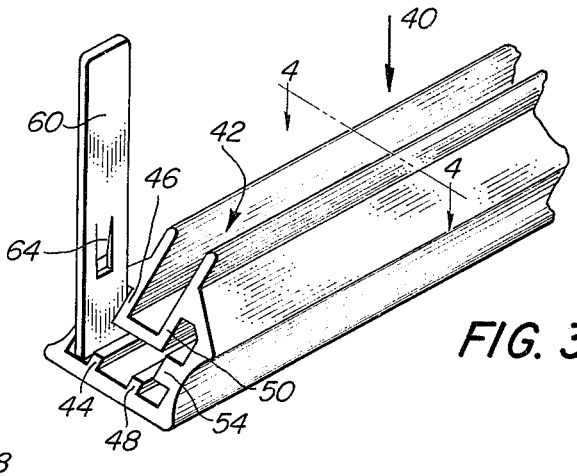
FIG. 3 is a partially cut away perspective view of the end of a frame member and L-shaped angle joiner as described herein.
Figure 4:
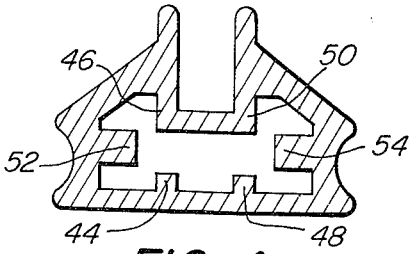
FIG. 4 is a cross-sectional view taken along the line 4—4 of FIG. 3.
Figure 5:
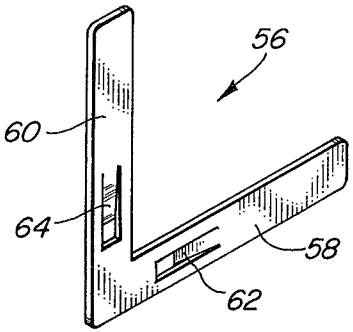
FIG. 5 is a perspective view of an L-shaped angle joiner suitable for joining two frame members at a right angle.

The construction of an individual frame member and a suitable joiner are illustrated in FIGS. 3, 4 and 5. Frame member 40 can be fabricated from any rigid material such as metal or plastic; it is preferred to extrude frame members from aluminum, however. Means to mount a poster, such as U-shaped groove 42, are provided on the outer surface of frame 40 in such a location so as to face inwardly on the assembled frame. The outer walls of frame member 40 define a hollow inner cavity which provides a location for fastening frame members together by inserting a joiner having at least two legs therein. The cavity of frame 40 contains a set of first guide means and a set of second guide means, each set defining a slot therebetween, for receiving one leg of a joiner. Thus, frame 40 can be joined to another frame member by one or a pair of joiners. As shown, one first guide means is formed by lower shoulder 44 and wall member 46 which is part of the lower portion of poster mounting groove 42; the other first guide means is similarly formed from lower shoulder 48 and wall member 50 which is also part of the lower portion of groove 42. The set of second guide means consists of side shoulders 52 and 54, respectively. Thus, within the inner cavity of frame member 40, the first guide means consisting of lower shoulder 44 and wall member 46 and the second guide means consisting of side shoulder 52 define between them a slot which is capable of receiving one leg of a frame joiner. Similarly, the first guide means consisting of lower shoulder 48 and wall member 50 and the second guide means consisting of side shoulder 54 define between them a slot capable of receiving one leg of another frame joiner. It is possible, of course, to provide frame members having only one pair of first and second guide means therein, or alternatively, to provide frame members having more than two sets of first and second guide means.

Frame members can be joined by a joiner having at least two legs; one leg is inserted in each of two frame members. An L-shaped angle joiner 56 is illustrated in FIG. 5, and shown inserted into frame 40 in FIG. 3. L-shaped angle joiner 56 has two legs, 58 and 60, which are positioned at a right angle to each other. Legs 58 and 60 each contain a raised tongue portion 62 and 64, respectively. Raised tongue portions 62 and 64 are designed to cooperate with the second guide means, such as side shoulders 52 and 54 within frame member 40, to secure the joiner 56 within the slot provided within frame members. Thus, when L-shaped joiner 56 is inserted into the slot defined by the first guide means consisting of shoulder 44 and wall member 46 and second guide means consisting of side shoulder 52, raised tongue 62 presses against shoulder 52 to tightly secure joiner 56 within frame 40. Leg 60 of joiner 56 can be inserted into a second frame member in a similar fashion to tightly secure two frame members together.

Figure 6:
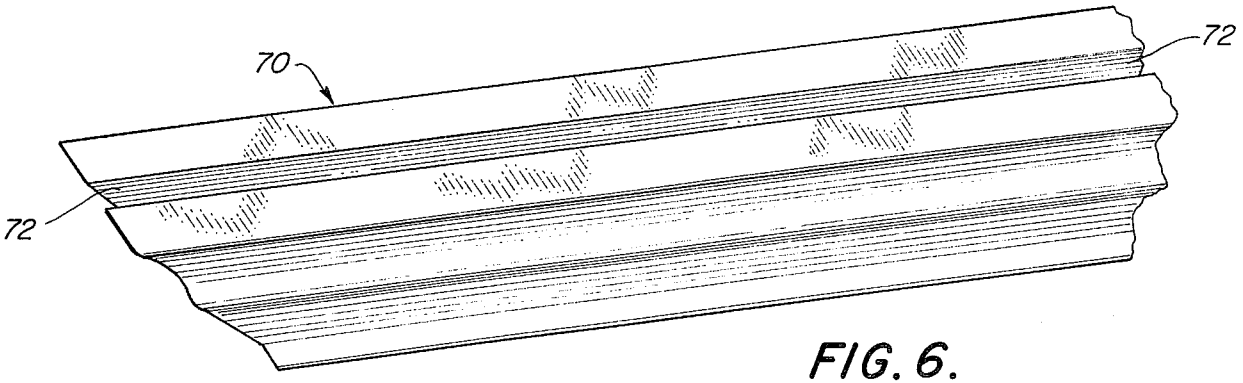
FIG. 6 is a partially cut away perspective view of the exterior of a frame member as described herein.

A cut away section of the outer wall for a frame member 70, clearly showing poster mounting groove 72, is illustrated in FIG. 6. The edge of a poster is inserted into groove 72 to mount the poster within a frame. Typically, groove 72 will run along the inside center of three frame members intended for use in a rectangular frame, whereas the upper or one of the side members will contain a slot through which the poster can be inserted.

Figure 7:
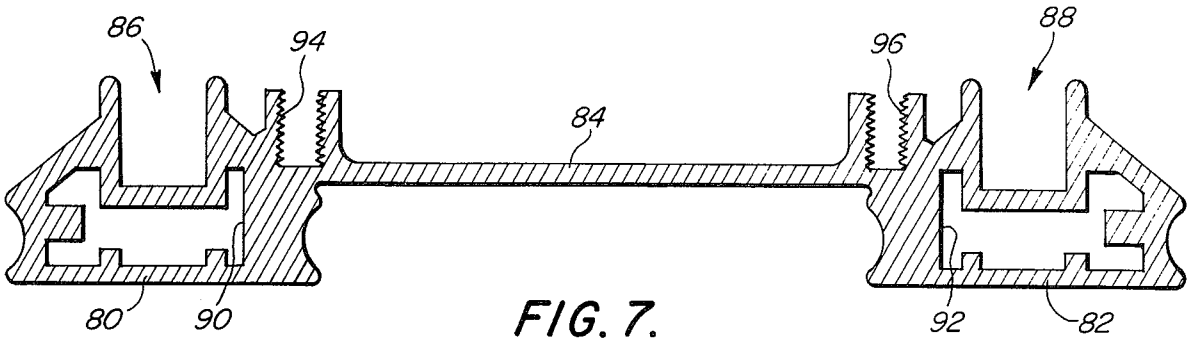
FIG. 7 is a cut away cross-sectional view of a base frame member suitable for use in a frame assembly having backlighting means within the frame.

FIG. 7 illustrates a cross-sectional view of a lower frame assembly suitable for serving as the base of a poster display containing back-lighting. It consists of outer frame members 80 and 82 which are integrally connected by lower wall 84. Each of frame members 80 and 82 has a poster mounting groove, 86 and 88, respectively, and are otherwise similar in detail to the frame members heretofore described except that one of the second guide means in each has been changed from a shoulder to inner side wall members 90 and 92. Inner side wall members 90 and 92 cooperate in a similar fashion with appropriate joiners to secure frame members 80 and 82 to other frame members. The base assembly shown also contains sunken threads 94 and 96 which can extend linearly along the base assembly thereby providing threaded tracks to which items such as a lamp base can be screwed.

Figure 8:
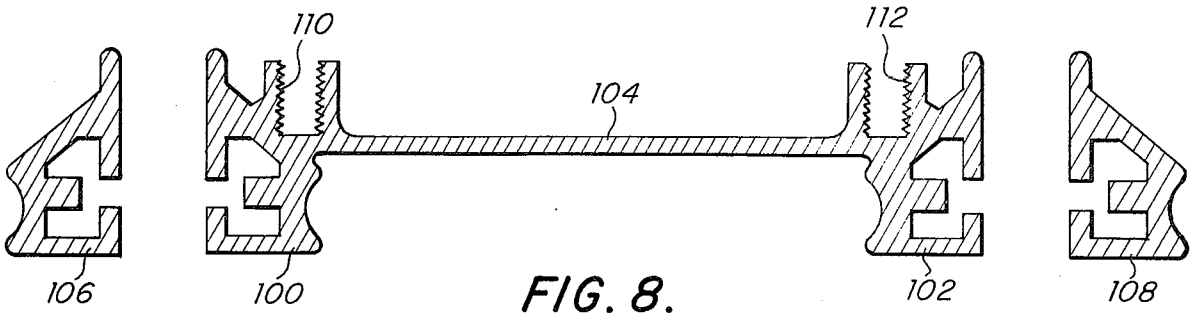
FIG. 8 is a cut away cross-sectional view of a top frame member suitable for use with the base member of FIG. 7; and, FIG. 9 is a perspective view of a frame assembly for posters having back-lighting therein.

In FIG. 8, a cross-sectional view of an upper frame assembly for use with that shown in FIG. 7 is illustrated.

Frame members 100 and 102 are integrally connected by upper wall 104. Frame members 100 and 102 each only contain one set of first and second guide means for receiving the leg of a joiner. However, frames 106 and 108 are provided and each contains on set of first and second guide means. Frames 106 and 108 are not integrally connected to frames 100 and 102, but are spaced therefrom to provide slots in the upper frame assembly through which posters can be inserted for mounting in the back-lit frame assembly. The upper frame assembly shown is also provided with sunken screw threads 110 and 112.

Figure 9:
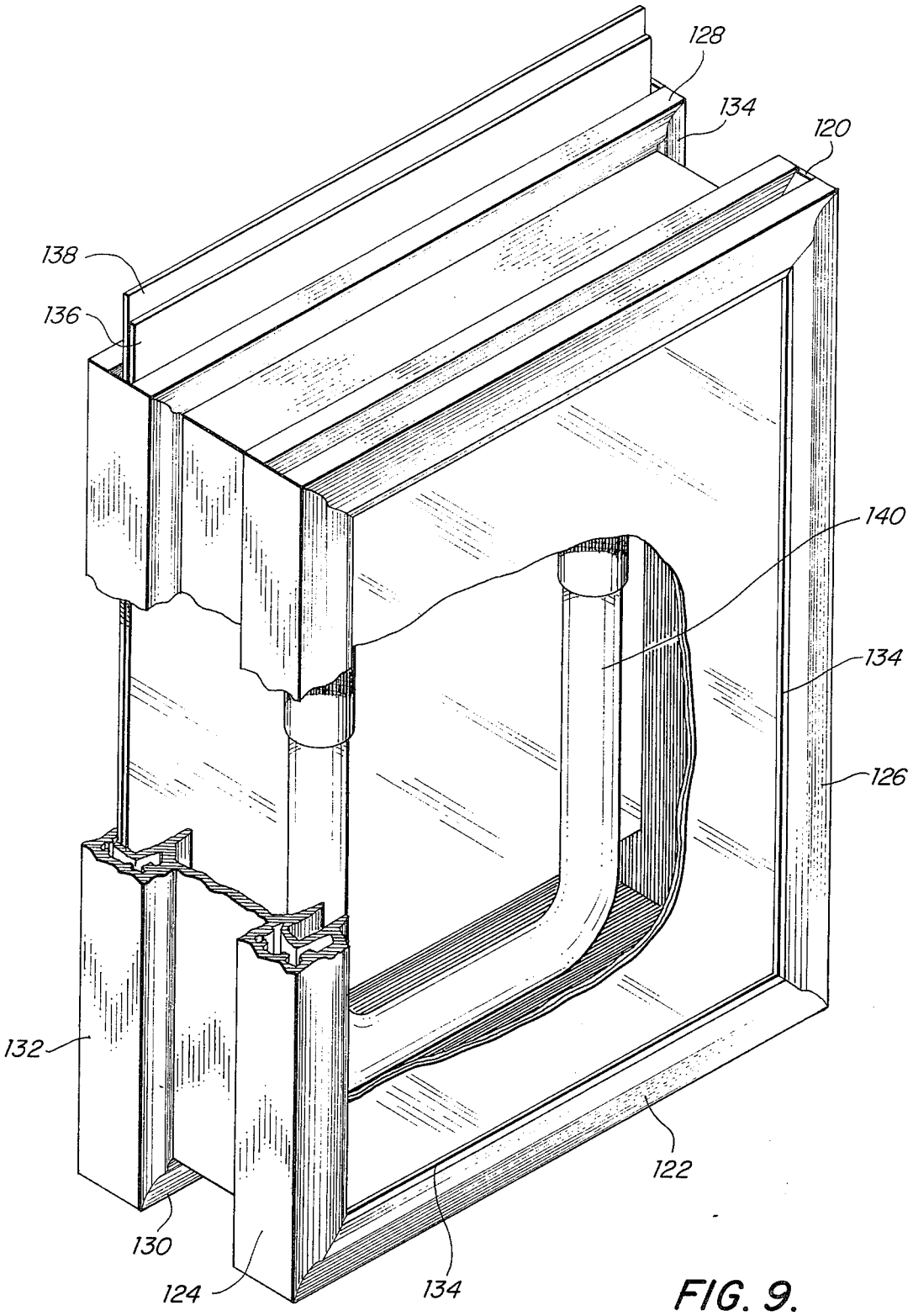

FIG. 9 illustrates a partially cut away perspective view of an assembled, enclosed poster display having back-lighting therein. Thus, the front frame assembly consists of slotted upper frame member 120, lower frame member 122, and side frame members 124 and 126. As shown, the front frame assembly does not contain any posters or other material. Rear frame assembly similarly consists of slotted upper frame member 128, lower frame member 130, and side frame members 132 and 134. All frame members except upper frame members 120 and 128 contain poster mounting grooves 134 on their inside outer surfaces, which are only illustrated on lower frame member 122 and side frame member 126 of the front frame assembly. Poster 136 and clear plastic protective sheet 138 are illustrated partially inserted through the slot in rear upper frame member 128; a poster and/or other material could likewise be inserted through the slot in front upper frame member 120. Fluorescent tube 140 provides back-lighting to illuminate material in either or both of the front or rear frame assemblies.

It will be understood that various other changes in the details, materials, steps, and arrangements of parts which have been described and illustrated in order to explain the nature of the invention will occur to and may be made by those skilled in the art upon a reading of this disclosure and such changes are intended to be included within the principle and scope of this invention which is limited only by the claims attached hereto.

What is claimed is:

1. A frame for displaying a poster or the like, comprising, in combination, a plurality of frame members joined to each other, each of said frame members having inner, outer and side walls which define a hollow cavity extending therethrough, said frame members also having a U-shaped holder positioned on the exterior of the inner frame wall into which one edge of a poster or the like can be inserted, the base of said U-shaped member extending through the inner frame wall and terminating at the inner side of said hollow cavity, said hollow cavity also containing first guide means and second guide means defining therebetween a slot for receiving one leg of an L-shaped angle joiner having raised tongues on one side thereof, said first guide means being a shoulder extending into said cavity from the inner surface of said outer frame wall and a side of said base of the U-shaped holder where said holder extends into said hollow cavity, said shoulder and base having colinear surfaces, and said second guide means comprising a shoulder extending along the inner surface of a side wall of said frame, the shoulder extending along the inner surface of said side wall being positioned to cooperate with a raised tongue on said L-shaped angle joiner to tightly secure frame members together when said L-shaped angle joiner is inserted into the slot between said first and said second guide means thereof.

2. A frame of claim 1 wherein said plurality of frame members comprises four frame members joined into a rectangular shape.

3. A frame of claim 2 wherein each of said frame members contains a hollow cavity having a pair of first guide means and a pair of second guide means.

4. A frame of claim 3 formed from extruded aluminum.

5. A frame of claim 4 having means for lighting said poster or the like associated therewith.

6. A frame of claim 1 formed from extruded aluminum.

7. A frame of claim 1 having means for lighting said poster or the like associated therewith.

* * * * *